United States Patent [19]

Colombani

[11] Patent Number: 4,680,816

[45] Date of Patent: Jul. 21, 1987

[54] MULTIPLE-RING TOILET SEAT ASSEMBLY AND MOUNTING MEANS

[76] Inventor: Louie V. Colombani, 49 W. Lincoln Ave., Unit A, Woodland, Calif. 95695

[21] Appl. No.: 898,805

[22] Filed: Aug. 21, 1986

Related U.S. Application Data

[63] Continuation of Ser. No. 651,882, Sep. 19, 1984, abandoned.

[51] Int. Cl.[4] ..... A47K 13/12

[52] U.S. Cl. ..... 4/240; 4/236

[58] Field of Search ..... 4/236, 234, 237, 240

[56] References Cited

U.S. PATENT DOCUMENTS 564,583 7/1896 Barrett ..... 4/236
940,435 11/1909 Craig ..... 4/240 X
2,064,628 12/1936 Raflovich ..... 4/240
3,032,777 5/1962 Young ..... 4/240
3,608,100 9/1971 Trost ..... 4/236

FOREIGN PATENT DOCUMENTS 838729 5/1938 France ..... 4/240
221971 9/1924 United Kingdom ..... 4/240

*Primary Examiner*—Charles E. Phillips
*Attorney, Agent, or Firm*—Flehr, Hohback, Test, Albritton & Herbert

[57] ABSTRACT

A toilet seat assembly arranged to be readily and simply decoupled from a toilet bowl for cleaning includes an improved pivotable mounting assembly whereby forces will not be applied to any significant degree to the pivot pins. Further, the mounting arrangement reduces, if not eliminates, wobble of the seat relative to the bowl. A child's seat nests within the above assembly.

3 Claims, 4 Drawing Figures

MULTIPLE-RING TOILET SEAT ASSEMBLY AND MOUNTING MEANS

This application is a continuation, of application Ser. No. 651,882, filed 9-19-84 abandoned.

This invention pertains to an improved toilet seat assembly and, more particularly, to such an assembly which can be readily demounted from the toilet bowl for cleaning both the bowl and the toilet seat assembly.

It has been observed that heretofore the weakest part of a typical toilet seat assembly is located in the region of the hinge which serves to couple or mount the assembly to the toilet bowl.

It has also been observed that a readily demountable toilet seat assembly permits both the bowl and the assembly to be more readily cleaned but that an improved mounting assembly is needed.

SUMMARY OF THE INVENTION AND OBJECTS

In general, a toilet seat assembly as provided herein includes a bracket adapted to be secured to the top of the toilet bowl and an annular seat portion. Also a lid forms a cover for the seat portion and pivots from pins coupling both the seat portion and lid to the bracket. The pivot pins are axially movable relative to each other between retracted and protruding positions and exposed externally of the lid to permit the pins to be moved to their retracted positions to release both the lid and seat portion from the bracket for cleaning.

In addition, the sides of the pins are tapered to be progressively larger at positions progressively remote from their outer ends. Spring means interposed between the pins serves to urge the pins apart to provide a snug fit with openings in the bracket thereby limiting looseness in mounting the seat and lid.

In general, it is an object of the present invention to provide an improved toilet seat assembly and improved means for coupling the seat and lid to a mounting bracket.

It is another object of the present invention to provide a toilet seat assembly wherein the rear portion of the toilet seat rests directly upon a mounting bracket and wherein the lid also is disposed to rest upon the mounting bracket for supporting weight on the lid.

Yet, another object of the invention is to provide a toilet seat assembly employing a plurality of annular seat portions, both of which are coupled to pivot about a common axis, and wherein one of the seat portions is nested concentrically upon and within the other seat portion.

Additional objects and advantages of the invention will become readily evident from the following detailed description of a preferred embodiment when considered in conjunction with the drawings.

DETAILED DESCRIPTION OF PREFERRED EMBODIMENT

Figure 1:
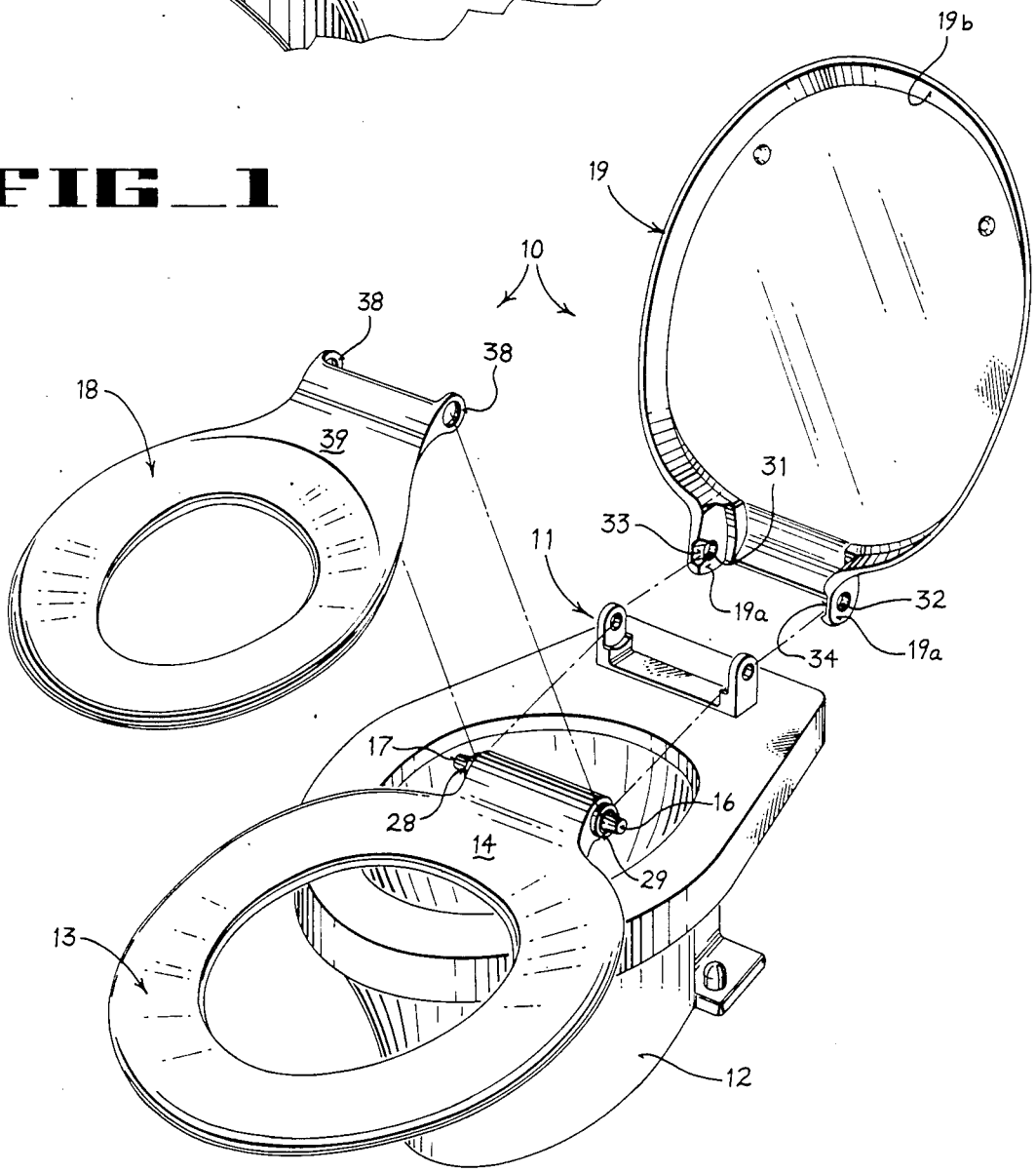
FIG. 1 shows a diagrammatic perspective exploded view of a toilet seat assembly for use with a toilet bowl according to the invention.

As shown in FIG. 1, a toilet seat assembly 10 according to the invention generally includes a bracket 11 adapted to be secured to the top rear surface 12*a* of a toilet bowl 12. An annular seat portion o3 of assembly 10 includes a rearwardly extending mounting hinge portion 14 comprising a hollow body 14*a* carrying pivot pins 16, 17 for engaging bracket 11. An additional annular seat portion 18 coupled to pins 16, 17 is typically nested within seat portion 13, whereby both seat portions 13, 18 pivot about the axis 23 of pins 16, 17 as they are moved either together or separately between lowered and raised positions and vice versa.

Pins 16, 17, as described further below, are arranged to move axially with respect to each other whereby a lid 19 can be readily coupled to pins 16, 17.

Figure 2:
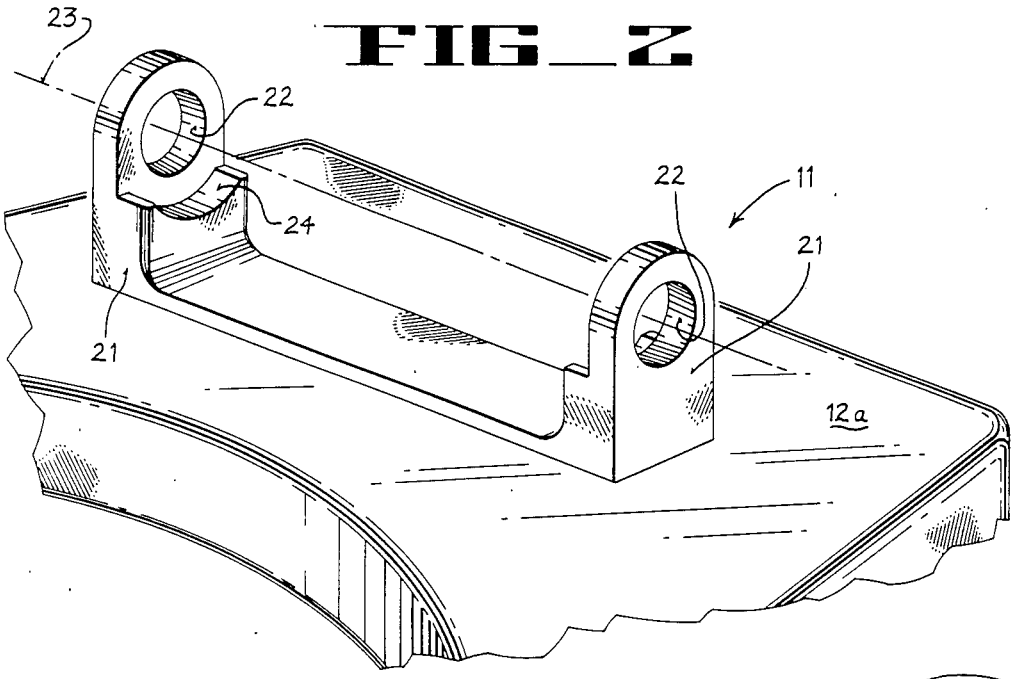
FIG. 2 shows an enlarged detailed view of a mounting bracket for use in coupling the toilet seat assembly to a bowl according to the invention.

Mounting bracket 11 as shown in FIG. 2 is adapted to be secured to the top rear surface 12*a* of bowl 12 as by means of gluing the undersurface of bracket 11 thereto or by using other suitable means employing the typical openings (not shown) located in the rear portion of bowl 12. Bracket 11 includes a pair of spaced apart upright support pillars 21. Pillars 21 each include an opening 22 extending through its associated pillar from one side face to the other. As thus arranged, openings 22 lie on a common axis 23 for receiving pins 16, 17, therein.

Figure 3:
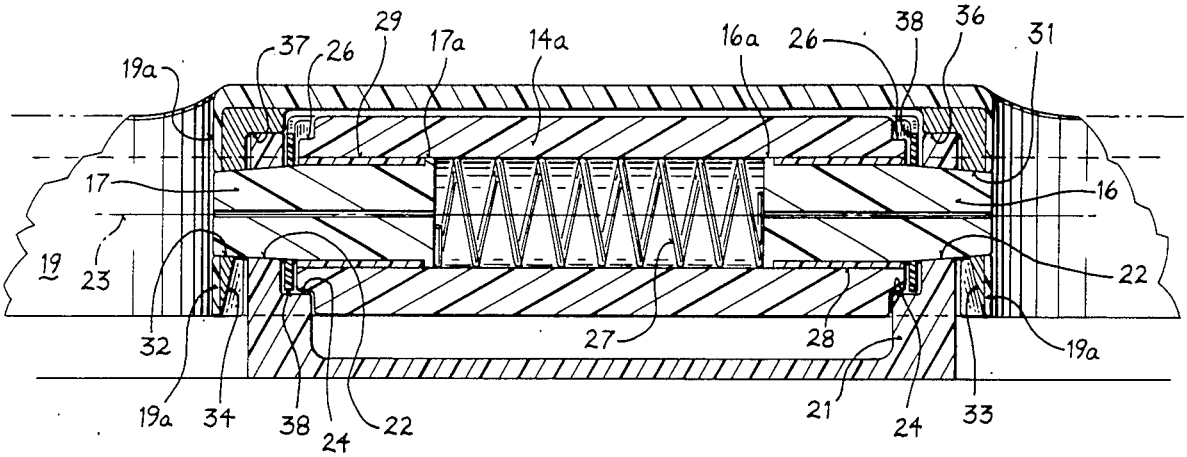
FIG. 3 shows an enlarged diagrammatic elevation section view taken along the center line of the coupling means and bracket and as viewed from behind.
Figure 4:
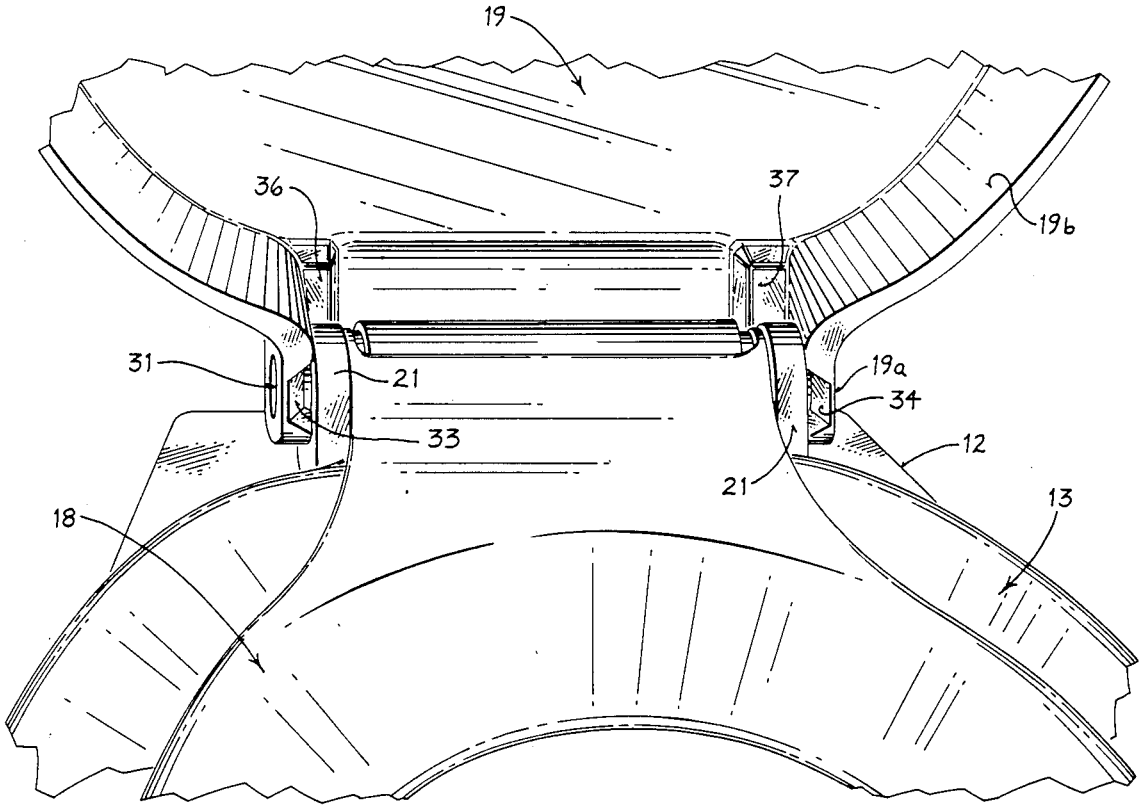
FIG. 4 shows an enlarged diagrammatic perspective view of the mounting portion of a toilet seat assembly according to the invention.

Pillars 21 include support shoulders, such as the arcuate shoulders 24 formed on the confronting faces of pillars 21. Shoulders 24 serve to support annular end bosses 26 (FIG. 3) formed as an exterior portion of the body 14*a* of mounting hinge portion 14.

Means for readily decoupling seat assembly 10 from bracket 11 comprises the tapered pivot pins 16, 17 protruding from opposite ends of the hollow body 14*a*, forming a portion of mounting hinge portion 14. The tapered pins 16, 17 each engage a correspondingly tapered edge of one of openings 22. A spring 27 interposed between pins 16, 17 and serves to urge them relatively apart.

Pins 16, 17 move within an associated one of two bushings 28, 29. Each of pins 16, 17 is formed a the rear with a flange portion 16*a*, 17*a* for engaging the innermost end of an associated one of two stationary bushings 28, 29 to prevent spring 27 from discharging pins 16, 17 from body 14*a*. Preferably, in order to simplify the process of assembling the device, one of the bushings may be glued or molded into its associated end of cylindrical housing 14*a*.

Accordingly, the spring loaded pins 16, 17, provide a snug fit with openings 22 in bracket 11 so as to limit looseness in mounting the seat and lid to the bracket, while simplifying alignment. Pins 16, 17 have axial passages 20 to relieve air therethrough when pins 16, 17 are moved together as well as to drain any water trapped between pins 16, 17 in housing 14*a*.

Lid 19 includes means for coupling the rear of the lid to pins 16, 17 to permit lid 19 to pivot between raised and closed positions. Thus, lid 19 includes a downwardly depending flange 19*a* on each side of bracket 11. Flanges 19*a* include openings 31, 32 which are aligned to receive the ends of pins 16, 17, therethrough.

Tapered slots 33, 34, formed in each flange 19*a* lead into an associated opening 31, 32. The depth of slots 33, 34 is the greatest at the edge of flange portions 19*a* and becomes progressively shallower as they approach their openings. Thus, slots 33, 34 can be readily disposed over the ends of pins 16, 17 then, by downwardly urging the rear of lid 19, slots 33, 34 cause pins 16, 17 to retract until they are aligned with and engaged within openings 31, 32.

Accordingly, it will be readily evident that the ends of pins 16, 17 are exposed externally of lid 19 so as to permit them to be manually moved to their retracted positions and quickly release both lid 19 and seat portion 13 from bracket 11.

Means providing additional strength and rigidity to the rear end of lid 19 includes a pair of small rigid portions or pads 36, 37 formed in the underside of lid 19 and disposed in position to engage and be supported by the tops of pillars 21. Thus, with lid 19 in its closed position, pads 36, 37 substantially engage the tops of pillars 21 so that downward force applied to the top of lid 19 at the rear will be transmitted directly to pillars 21 and then directly into bowl 12.

In the alternative, some minor degree of clearance could possibly be permitted between pads 36, 37 and pillars 21 since minor clearance would be immediately taken up upon application of any force to the rear of lid 19.

In addition to the above, by providing a mounting assembly in the manner described above, an additional and smaller annular seat portion 18 for use by children includes a pair of mounting rings 38 carried to extend rearwardly from a mounting portion 39. Rings 38 may be coupled about axis 23 of pins 16, 17 to permit the smaller seat portion 18 to move upwardly with or separately from seat portion 13.

Seat portion 18 is nested concentrically upon seat portion 13 when both are in their lowered position. Seat portion 18 is similarly readily releasable upon release of lid 19 and seat portion 13, as noted above by depressing the ends of pins 16, 17.

Based on the foregoing it will be readily evident that the rear portion of seat 13 is supported directly upon pillars 21 rather than being supported upon its pivot pins. In addition, the lid or closure 19 is also supported to transmit any downward force directly onto the tops of pillars 21. Accordingly, the mounting assembly as disclosed above, provides a relatively strong and force-resistant arrangement in which the pivot pins are protected against receiving weight applied to seat 13 or lid 19.

In addition, the entire unit, with the exception of bracket 11, can be quickly removed for cleaning bowl 12 and each portion of assembly 10. For use in hotels, the foregoing feature is believed to provide a substantial benefit in reducing room cleaning time and also in permitting families with children, particularly small children, to be accomodated by the management's quickly providing and installing the smaller child's seat 18.

In addition, by using the mounting means described above, the seat will be firmly mounted to eliminate any wobble or looseness in the seat relative to its mounting bracket. Further, when the assembly is removed for cleaning, there are no parts to get loose or lost other than relatively large pieces such as the lid, and the two seat portions since the pivot means is carried by the lower seat portion 14.

Finally, after assembling one or both of the seat portions 13, 18, lid 19 is readily applied by engaging the leading end of the peripheral flange 19*b* with the leading end of seat portion 13. In this position slots 33, 34 will be aligned to pass over the ends of pins 16, 17 so that the rear end of lid 19 can be pressed downwardly and thereby mounted.

From the foregoing it will be readily evident that use of a child's seat 18 does not preempt the use of the larger adult's seat 13 whereby they both can be used on an either/or basis. Further, the ease with which lid 19 can be removed and replaced makes it readily feasible to substitute lids of different colors to correspond with changes in decor, while also enabling the seat and lid to be readily removed for thorough cleaning.

What is claimed:

1. In a toilet seat assembly having a seat portion and an elongate mounting portion disposed to extend transversely of and rearwardly therefrom, said mounting portion carrying hinge pins protruding laterally therefrom, a mounting bracket adapted to be secured to the top rear surface of a toilet bowl, said bracket comprising a pair of laterally spaced apart upright support pillars, said pillars each including an opening extending transversely therethrough from one said to the other for receiving a hinge pin therein, arcuate support shoulders formed on the confronting faces of said pillars, said mounting portion including annular end bosses formed to protrude from the ends of said mounting portion for resting downwardly upon said shoulders to form a pivot support independent of said hinge pins, said cylindrical supports riding in and being supported by said shoulders in a manner providing substantially all support to the rear of said seat assembly by isolating said pins from applied weight acting thereon.

2. In a toilet seat assembly having a seat portion formed to include a rearwardly extending elongate mounting portion disposed transversely thereof and having a hollow body and cylindrical end bosses disposed to protrude laterally from said hollow body, hinge pins housed in said hollow body and extending from said body coaxially of said end bosses, a mounting bracket formed and adapted to be secured to the top rear surface of a toilet bowl, said bracket including a pair of spaced apart upstanding support pillars, said pillars each including an opening therein, arcuate support shoulders formed on the confronting faces of said pillars and disposed to support said end bosses from beneath to form a pivot independently of said pins to support the rear of said seat portion thereon, and means for readily releasably coupling said mounting portion to said pillars to permit said seat portion to be readily removed from said pillars.

3. In a toilet seat assembly according to claim 2 in which the last named said means comprises a pair of pivot pins protruding coaxially from opposite ends of said hollow body, the side of said pins having an elongate taper thereto for engaging the inner edge of said openings in said pillars, and spring means interposed between said pivot pins for urging said pins relatively apart to cause the taper of said pins to move the axis of said pins centrally of said openings.

* * * * *